US005171948A

United States Patent [19]

Ishii

[11] Patent Number: 5,171,948

[45] Date of Patent: Dec. 15, 1992

[54] HIGH FREQUENCY HEATING APPARATUS

[75] Inventor: Kazunori Ishii, Tajimi, Japan

[73] Assignee: Kabushiki Kaisha Toshiba, Kanagawa, Japan

[21] Appl. No.: 646,093

[22] Filed: Jan. 25, 1991

[30] Foreign Application Priority Data

Mar. 30, 1990 [JP] Japan ..... 2-85729

[51] Int. Cl.[5] ..... G05F 1/70; H05B 6/04

[52] U.S. Cl. ..... 219/10.55 B; 219/10.55 F; 323/207; 323/285; 323/301

[58] Field of Search ..... 219/10.55 B, 10.55 F, 219/10.55 R; 323/207, 283, 284, 285, 301; 363/142, 143, 285, 287; 328/267

[56] References Cited

U.S. PATENT DOCUMENTS 4,002,875 1/1977 Kiuchi et al. ..... 219/10.55 B
4,005,370 11/1977 Kusunoki et al. ..... 328/267
4,415,964 11/1983 Scharfe, Jr. ..... 363/142
4,430,540 2/1984 Scalf ..... 219/10.55 B
4,533,809 8/1985 Eke ..... 219/10.55 B
4,725,948 2/1988 Mierzwinski ..... 219/10.55 B
4,843,202 6/1989 Smith et al. .
4,900,885 2/1990 Inumada ..... 219/10.55 B
4,904,837 2/1990 Low et al. ..... 219/10.55 B
4,931,609 6/1990 Aoki ..... 219/10.55 B
4,933,830 6/1990 Sato et al. ..... 219/10.55 B

FOREIGN PATENT DOCUMENTS 2206750A 1/1989 United Kingdom .

*Primary Examiner*—Bruce A. Reynolds
*Assistant Examiner*—Tuan Vinh To
*Attorney, Agent, or Firm*—Philip M. Shaw, Jr.

[57] ABSTRACT

A high frequency heating apparatus includes a casing, an inverter enclosed in the casing, a magnetron supplied with high frequency voltage from the inverter, and three attachment plugs each connected to one of external power supplies of different output voltages. The attachment plugs are connected to the inverter input side via respective power supply selecting switches. The apparatus further includes three display panels one of which is selectively attached to the apparatus. Each display panel has an indicia indicative of one of the power supply voltages used and two projections selectively turning off the other two power supply selecting switches when attached to the apparatus.

4 Claims, 3 Drawing Sheets

HIGH FREQUENCY HEATING APPARATUS

BACKGROUND OF THE INVENTION

This invention relates to a high frequency heating apparatus in which an input power supply is converted by a frequency converter to a high-frequency electric power, which is supplied via a step-up transformer into a magnetron to drive the same, and more particularly to such a high frequency heating apparatus which can be supplied with electric power not only from a commercial power supply but other power supplies such as an automobile battery.

In high frequency heating apparatus which have been commercially produced, an electric power from a commercial power supply is supplied to an inverter or frequency converter to be converted to a high frequency power, which power is supplied to a magnetron through a step-up transformer so that the magnetron is driven for cooking food by way of high frequency heating, as well known in the art. In such a conventional high frequency heating apparatus, the magnitude of the electric wave or high frequency output depends upon the magnitude of a magnetron anode current which further depends upon an "on" period of a frequency converter switching element for the frequency conversion. Accordingly, in many cases, the "on" period of the frequency conversion switching element is determined in accordance with one commercial power supply voltage such that the anode current is maintained at a predetermined value. Levels of the heating intensity are adapted to be changed by driving the magnetron continuously or intermittently without controlling the magnitude of the anode current.

When the conventional high frequency heating apparatus employing the above-described arrangement for determining the high frequency output and the heating intensity is used in a region where a rated voltage of the commercial power supply differs from that determined for the apparatus or when the rated voltage of the commercial power supplies provided differs from room to room, the magnetron may not be normally operated because of a low input voltage or to the contrary, an abnormal voltage may be applied to the magnetron because of a high input voltage. Furthermore, it is almost impossible to operate the high frequency heating apparatus when the same is arranged to be supplied with the electric power from an automobile battery for an outdoor dinner. That is, it is almost impossible to use the conventional high frequency heating apparatus from place to place easily according to different power supplies provided.

SUMMARY OF THE INVENTION

Therefore, an object of the present invention is to provide a high frequency heating apparatus which can be used according to different power supplies, can be carried with ease and can enlarge the limits of use.

Another object of the invention is to provide a high frequency heating apparatus which can be supplied with a high frequency output, the value of which is most suitable for a power supply coupled with the apparatus.

Further another object of the invention is to provide a high frequency heating apparatus which can prevent simultaneous inputs thereto from two or more external power supplies.

The present invention provides a high frequency heating apparatus comprising first and second power supply connecting terminals adapted for connection to first and second external power supplies, respectively, a frequency converter having a power input terminal to which an input power is supplied selectively from the first or second power supply connecting terminal, the frequency converter converting the input power to high frequency power, a step-up transformer stepping up an AC output supplied thereto from the frequency converter, a magnetron connected to an output side of the step-up transformer, and output changing means for changing a magnetron output power so that the magnetron output power takes the values in accordance with voltages applied to the first and second power supply connecting terminals respectively.

Upon connection of either corresponding first or second power supply connecting terminal to a power supply provided in a place where the apparatus is used, the output changing means is operated such that the magnetron anode current is set so that the magnitude of output electric waves correspond to the voltage of the connected power supply. Consequently, the magnetron may be normally operated even if the power supply voltage changes from power supply to power supply. That is, since the high frequency heating apparatus in accordance with the invention may be supplied with the electric power even if the power supply differs from place to place, the apparatus may be carried to places where different power supplies are provided.

The invention may also be practiced as a high frequency heating apparatus comprising, in addition to the above-described construction, first and second power supply selecting switches connected between the first and second power supply connecting terminals and the power input terminal of the frequency converter respectively, a casing enclosing the frequency converter, the step-up transformer and the magnetron, first and second display means selectively provided on the casing when the external power supplies connected selectively to the first and second power supply terminals, respectively, thereby displaying indicia for identifying the respective external power supplies, and actuators provided in the respective first and second display means for holding the respective first and second power supply selecting switches either closed or open, in response to provision of the respective first and second display means on the casing.

The indicia indicative of the power supply selectively connected to the power input terminal is displayed on the display means. Additionally, selective closure and opening of the first and second power supply selecting switches upon provision of the display means on the apparatus prevents simultaneous connection of different power supplies to the power input terminal.

Other objects of the present invention will become obvious upon understanding of the illustrative embodiment about to be described or will be indicated in the appended claims. Various advantages not referred to herein will occur to one skilled in the art upon employment of the invention in practice.

DESCRIPTION OF THE PREFERRED EMBODIMENT

An embodiment of the present invention will be described with reference to the accompanying drawings.

Figure 1:
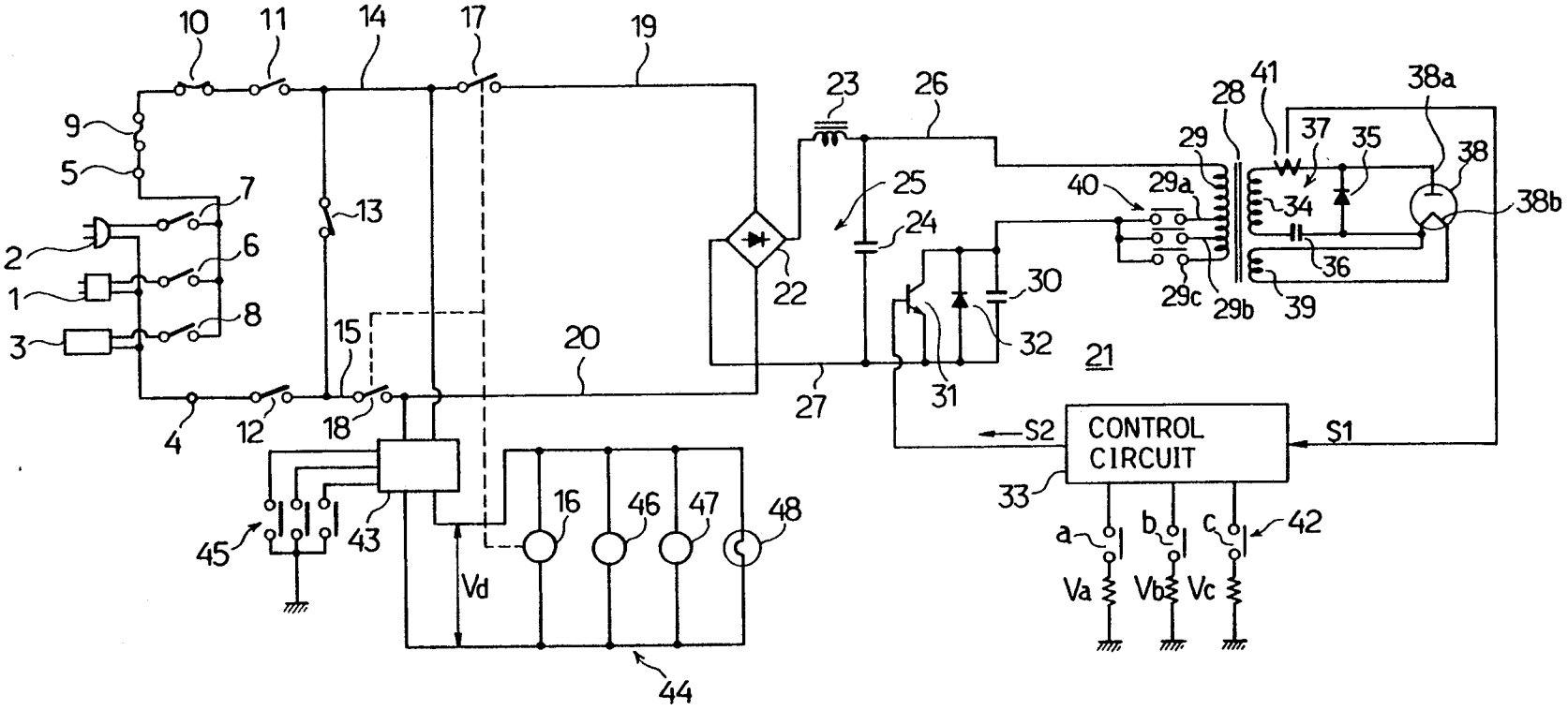
FIG. 1 is an electric circuit diagram of a high frequency heating apparatus in accordance with the present invention.

Referring to FIG. 1, a high frequency heating apparatus of the embodiment is provided with first to third attachment plugs 1 to 3 capable of being connected to three external power supplies, for example, 100 V and 200 V power supplies and a 12 V automobile battery, respectively. One end of each plug is connected to a power input terminal 4 and the other end of each plug is connected to another power input terminal 5 through power supply selecting switches 6 to 8, respectively. The terminals 4 and 5 are arranged into a pair and connected to lines 14 and 15 through a well-known protector circuit comprising a fuse 9, a thermal switch 10, door switches 11, 12 and a short-circuit switch 13. The lines 14, 15 are connected to AC bus bars 19, 20 via contacts 17, 18 of a timer 16 for setting a cooking period, respectively. A main inverter unit or frequency converter 21 comprises a rectification circuit 22 full-wave rectifying AC voltage induced between the bus bars 19, 20. The rectified voltage is applied as DC voltage between DC bus bars 26, 27 through a filter circuit 25 comprising a choke coil 23 and a smoothing capacitor 24. An oscillation circuit for the frequency conversion comprises a primary winding 29 of a step-up transformer 28, a resonance capacitor 30, a switching transistor 31 serving as a switching element for the frequency conversion and a diode 32. An on-off control of the switching transistor 31 by a control circuit 33 causes a high frequency current in the primary winding 29 of the step-up transformer 28. Consequently, a high frequency voltage is induced in a secondary winding 34 of the step-up transformer 28. The high frequency voltage is applied across an anode 38*a* and a cathode 38*b* of a magnetron 38 through a voltage doubler rectifier circuit 37 comprising a diode 35 and a capacitor 36. A voltage induced in a tertiary winding 39 is applied to the cathode 38*b*. Reference numeral 40 designates a winding turn selecting switch for selecting a suitable turn of the primary winding 29 of the transformer 28. The winding turn selecting switch 40 is operated so that the resonance capacitor 30 is connected selectively to one of taps 29*a*, 29*b* and 29*c* extended out from different turns of the primary winding 29. An anode current detector 41 comprising a current transformer is provided in an anode current path of the magnetron 38. A detection signal $S_1$ generated by the anode current detector 41 is supplied to the control circuit 33. The control circuit 33 is provided with an output selecting switch 42 serving as output changing means. One of values $V_a$, $V_b$ and $V_c$ previously set by a resistance circuit is selected by the output selecting switch 42 so that an output of the magnetron 38 is set to set outputs of 300 W, 600 W and 1,000 W in accordance with the respective power supply voltages 12 V, 100 V and 200 V applied across the power input terminals 4, 5. Furthermore, the control circuit 33 operates to compare the detection signal $S_1$ generated by the anode current detector 41 with one of the set values $V_a$, $V_b$, $V_c$ selected by the output selecting switch 42, thereby generating a base signal $S_2$ having a pattern in accordance with the difference obtained as a comparison result. The base signal $S_2$ is used to control an "on" period of the switching transistor 31 so that the output of the magnetron 38 is maintained at a set value. An auxiliary inverter 43 is provided for supplying the power supply voltage $V_d$ to an electric circuit 44 composed of the timer 16, a turntable motor 46, a fan motor 47 for cooling the magnetron 38 and a pilot lamp 48. The auxiliary inverter 43 is provided with a frequency selecting switch 45 for maintaining the output voltage $V_d$ at a predetermined value even when the power supply voltages of different values are supplied through one of the attachment plugs 1 to 3. Thus, the frequency switching operation of the frequency selecting switch 45 maintains the output voltage $V_d$ as a secondary voltage of a transformer provided in the auxiliary inverter 43 at the predetermined value even when the voltage of the different value is supplied from one of the attachment plugs 1 to 3.

Figure 2:
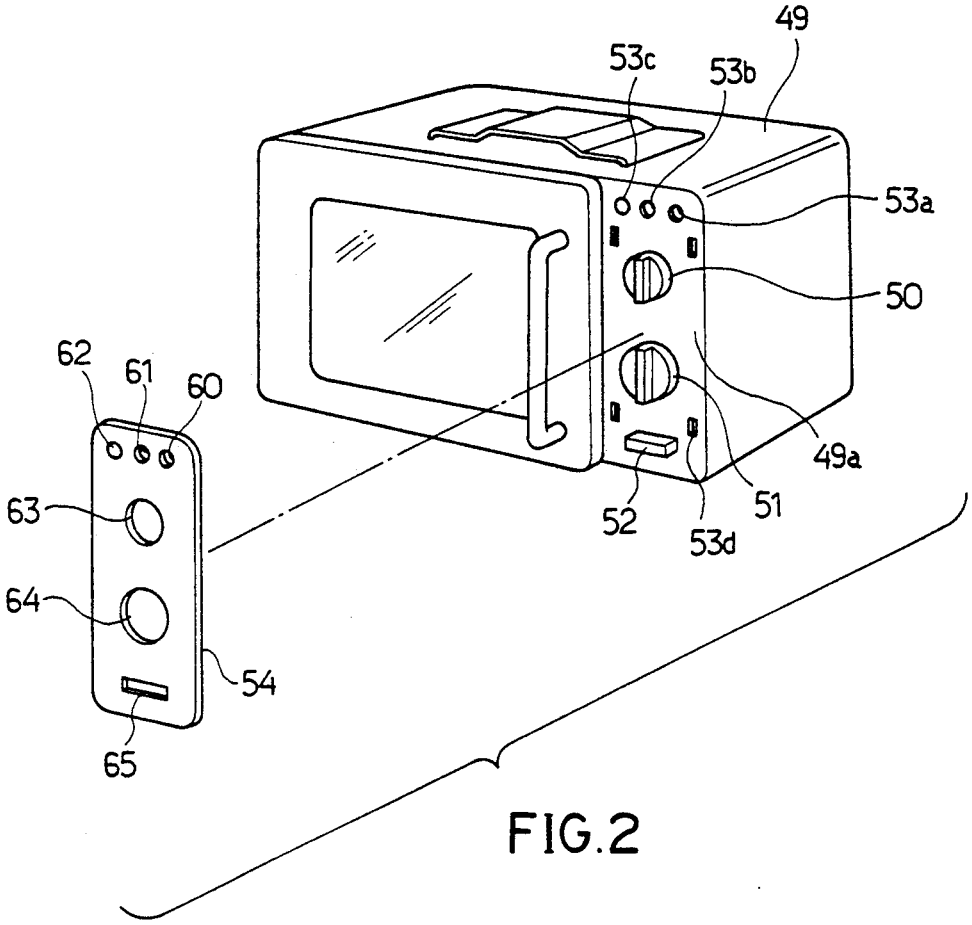
FIG. 2 is a perspective view of the high frequency heating apparatus with a display panel separated.
Figure 3:
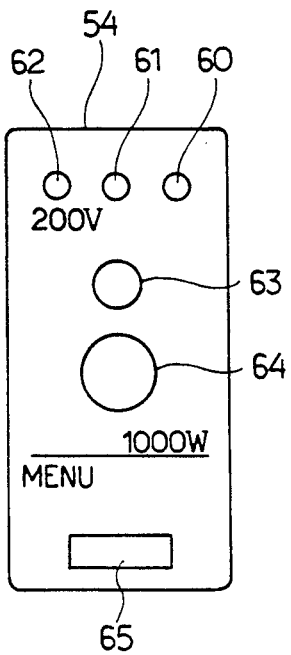
FIGS. 3 to 5 are front views of the display panels corresponding to different power supply voltages.
Figure 4:
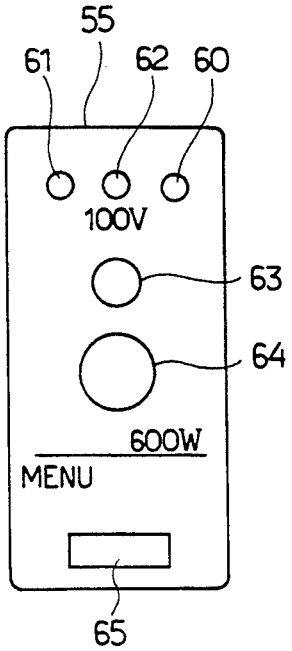
Figure 5:
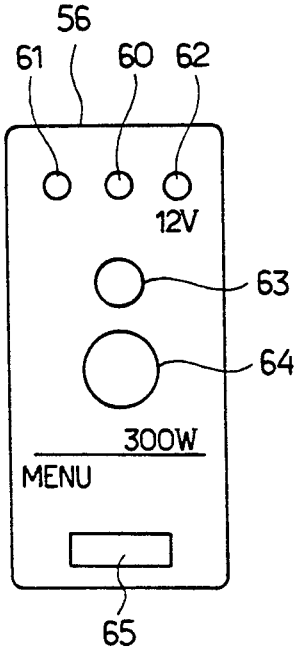
Figure 7:
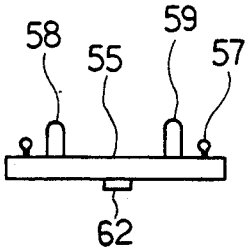
FIG. 7 is a top plan view of the display panel shown in FIG. 3.
Figure 6:
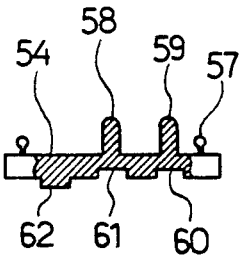
FIG. 6 is a partially broken top plan view of the display panel shown in FIG. 4.
Figure 8:
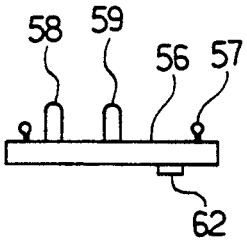
FIG. 8 is also a top plan view of the display panel shown in FIG. 5.

Referring now to FIGS. 2 to 8, an operation panel 49*a* serving as an operation section is mounted on the front side of the high frequency heating apparatus 49. On the operation panel 49*a* are mounted an output level switching knob 50, a timer operating knob 51 and a cooking start knob 52 as well known in the art. Furthermore, three through-holes 53*a*, 53*b* and 53*c* are formed in the upper portion of the operation panel 49*a* in the embodiment of the invention. The operation panel 49*a* further has four engagement apertures 53*d* as shown in FIG. 2. Three display panels 54 to 56 are provided so as to correspond to the respective external power supplies so that one of the power supplies is selected. Four engagement pins 57 formed on the backside of each of the display panels 54–56 are engageable with the respective engagement apertures 53*d*. Thus, the display panels 54–56 are exchangeably attached to the operation panel 49*a*. Each display panel is provided with two actuators or operating projections 58 and 59 which are inserted in two of the holes 53*a*–53*c* in the condition that each display panel is attached to the operation panel 49*a*, each of the three holes having predetermined locations in accordance with the respective external power supplies. Display recesses 60 and 61 are formed on the front of each display panel so as to correspond to the respective operating projections 58, 59 corresponding to two of the holes 53*a*–53*c* respectively and a display projection 62 is also formed on the front of each display panel so as to correspond to the other of the holes 53*a*–5*ac*. The display panels 54–56 display indicia, "100 V," "200 V" and "12 V" respectively in the vicinity of the display projection 62, the indicia indicating the respective external power supplies to be used, that is, voltage values. The display panels 54–56 each have openings 63, 64 and 65 through which the output level switching knob 50, timer operating knob 51 and cooking start knob 52 are extended respectively in the condition that each display panel is attached to the operation panel 49*a*. Each display panel further has an indicia indicative of set output in accordance with the respective external power supplies such as 1,000 W, 600 W, 300 W and a menu suitable for the set output.

The power supply selecting switches 6–8, the winding turn selecting switch 40, output selecting switch 42 and frequency selecting switch 45 are of normally closed type and each has a moving contact disengaged from a fixed contact by the operating projections 58, 59 when they are inserted through two of the holes 53a–53c upon attachment of each display panel to the operation panel 49a. Consequently, a pair of contacts having a location corresponding to the voltage of the external power supply corresponding to the display panel attached to the operation panel 49a remain closed.

The operation of the above-described construction will be described. When an automobile battery of 12 volts is used as an external power supply, the display panel 56 is attached to the operation panel 49a. Consequently, the power supply selecting switch 8 is closed. The display panel 55 is attached to the operation panel 49a and the switch 6 is closed when the commercial power supply of 100 volts is used. The display panel 54 is attached to the operation panel 49a and the switch 7 is closed when the commercial power supply of 200 volts is used. The closure of each one of the switches 6–8 is attained by the opening of the other two switches by the operating projections 58, 59 With initiation of the cooking, one of the attachment plugs 1–3 is connected to desirable one of the external power supply and the power supply voltage is applied across the bus bars 19, 20. Simultaneously, with respect to the winding turn selecting switch 40, output selecting switch 42 and frequency selecting switch 45, the contacts having locations corresponding to the level of the applied voltage are closed by the operating projections 58, 59. When the power supply is thus put to the apparatus, the frequency converter 21 performs the frequency converting operation as in the usual high frequency heating apparatus and then, the magnetron 38 is driven such that the heating cooking operation is executed. In the heating cooking operation, the control circuit 33 compares the detection signal $S_1$ from the anode current detector 41 with one of the set values, $V_a$, $V_b$ and $V_c$ selected by output selecting switch 42, for example, with the set value $V_a$ and then, generates the base signal $S_2$. The "on" period of the switching transistor 31 is controlled in accordance with the magnitude of the base signal $S_2$, whereby the value of the magnetron 38 anode current is maintained so that one of the set output values, 300 W, 600 W and 1,000 W selected by the output selecting switch 42 is maintained. Although such a control of the switching transistor "on" period varies the operating frequency of the frequency converter 21 at the same time, the turns of the primary winding 29 of the step-up transformer 28 are switched by the winding turn selecting switch 40 with variation in the operating frequency of the frequency converter 21. Consequently, the inductance of the step-up transformer 28 is varied so that the resonance frequency of the frequency converter 21 normally agrees with an operating frequency.

According to the above-described high frequency heating apparatus, when the power supply is changed among the values of 12 V, 200 V and 300 V, the output of the magnetron 38 is accordingly switched among the values of 300 W, 600 W and 1,000 W respectively such that the magnetron 38 is driven under the output suitable for the power supply voltage. Consequently, the heating cooking may be performed without any trouble. Furthermore, in the foregoing embodiment, one of the display panels 54–56 is selectively attached to the operation panel 49a with the use of any one of the attachment plugs 1–3 such that one of the power supply switches 6–8 is selected and the power supply from the other two plugs is prevented. Misuses such as simultaneous power supply from a plurality of external power supplies may be prevented. Furthermore, viewing the voltage indicia displayed in the vicinity of the display recess 62, a user can visually perceive the power supply being used. Consequently, the cooking period may be set by the timer 16 to a desirable value in accordance with the output voltage from the external power supply.

The power supply selecting switches 6–8, winding turn selecting switch 40, output selecting switch 42 and frequency selecting switch 45 may not be operated in response to attachment of one of the display panels. These switches may be operated in response to the operation of a single rotatable knob. Furthermore, Push button switches may be provided so as to correspond to the respective holes 53a–53c. Additionally, although one power supply is selected from three ones in the foregoing embodiment, at least two power supplies may be selectively used.

The foregoing disclosure and drawings are merely illustrative of the principles of the present invention and are not to be interpreted in a limiting sense. The only limitation is to be determined from the scope of the appended claims.

I claim:

1. A high frequency heating apparatus comprising:

a) first and second power supply connecting terminals adapted for connection to first and second external power supplies, respectively;

b) a frequency converter having a power input terminal to which an input power is supplied selectively from the first or second power supply connecting terminal, the frequency converter converting the input power to high frequency power;

c) a step-up transformer stepping up an AC output supplied thereto from the frequency converter;

d) a magnetron connected to an output side of the step-up transformer; and e) output changing means for changing a magnetron output power so that the magnetron output power takes the values in accordance with voltages applied to the first and second power supply connecting terminals respectively.

2. A high frequency heating apparatus according to claim 1, which further comprises first and second power supply selecting switches and operating means for operating selectively the first or second switch, the first and second power supply selecting switches being connected between the first and second power supply connecting terminals and the power input terminal of the frequency converter respectively.

3. A high frequency heating apparatus comprising:

a) first and second power supply connecting terminals adapted for connection to first and second external power supplies, respectively;

b) a frequency converter having a power input terminal to which an input power is supplied selectively from the first or second power supply connecting terminal, the frequency converter converting the input power to high frequency power;

c) a step-up transformer stepping up an AC output supplied thereto from the frequency converter;

d) a magnetron connected to an output side of the step-up transformer;

e) output changing means for changing a magnetron output power so that the magnetron output power takes the values in accordance with voltages applied to the first and second power supply connecting terminals respectively;

f) first and second power supply selecting switches connected between the first and second power supply connecting terminals and the power input terminal of the frequency converter respectively;

g) a casing enclosing the frequency converter, the step-up transformer and the magnetron;

h) first and second display means selectively provided on the casing when the external power supplies connected selectively to the first and second power supply terminals, respectively, thereby displaying indicia for identifying the respective external power supplies; and i) actuators provided in the respective first and second display means for holding the respective first and second power supply selecting switches either closed open, in response to provision of the respective first and second display means on the casing.

4. A high frequency heating apparatus according to claim 3, wherein the first and second display means have another actuators operating the output switching means in response to provision of the first and second display means on the casing, respectively.

* * * * *